US011401593B2

(12) United States Patent
Chen et al.

(10) Patent No.: US 11,401,593 B2
(45) Date of Patent: Aug. 2, 2022

(54) MARAGING STEEL AND METHOD FOR MANUFACTURING SAME

(71) Applicant: Kobe Steel, Ltd., Kobe (JP)

(72) Inventors: Zhuyao Chen, Kobe (JP); Takeo Miyamura, Kobe (JP); Shigenobu Namba, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 161 days.

(21) Appl. No.: 16/489,492

(22) PCT Filed: Feb. 5, 2018

(86) PCT No.: PCT/JP2018/003763

§ 371 (c)(1),
(2) Date: Aug. 28, 2019

(87) PCT Pub. No.: WO2018/159219

PCT Pub. Date: Sep. 7, 2018

(65) Prior Publication Data

US 2020/0071804 A1 Mar. 5, 2020

(30) Foreign Application Priority Data

Mar. 2, 2017 (JP) ..... JP2017-039149
May 10, 2017 (JP) ..... JP2017-093877

(51) Int. Cl.
*C22C 38/52* (2006.01)
*C22C 38/06* (2006.01)
(Continued)

(52) U.S. Cl.
CPC ..... *C22C 38/52* (2013.01); *C21D 6/001* (2013.01); *C22C 38/02* (2013.01); *C22C 38/04* (2013.01);
(Continued)

(58) Field of Classification Search
CPC ..... C22C 38/52; C22C 38/06; C22C 38/105; C22C 38/44; C22C 38/50; C21D 2211/001; C21D 2211/008
(Continued)

(56) References Cited

U.S. PATENT DOCUMENTS 6,561,258 B1 * 5/2003 Kumpula ..... C21D 8/005 148/335
2017/0096728 A1 * 4/2017 Kamimura ..... C22B 9/16

FOREIGN PATENT DOCUMENTS

JP 51-126918 11/1976
JP 9-111 415 A 4/1997
WO WO-2015189919 A1 * 12/2015 ..... C22C 38/105

OTHER PUBLICATIONS

International Search Report dated Apr. 24, 2018 in PCT/JP2018/003763 filed on Feb. 5, 2018.
(Continued)

*Primary Examiner* — Humera N. Sheikh
*Assistant Examiner* — Katherine A Christy
(74) *Attorney, Agent, or Firm* — Oblon, McClelland, Maier & Neustadt, L.L.P.

(57) ABSTRACT

The invention relates to a maraging steel containing C: 0.02% (mass %, hereinafter the same) or less, Si: 0.3% or less, Mn: 0.3% or less, Ni: 7.0 to 15.0%, Cr: 5.0% or less, Co: 8.0 to 12.0%, Mo: 0.1 to 2.0%, Ti: 1.0 to 3.0%, and Sol.Al: 0.01 to 0.2%, where the balance includes Fe and unavoidable impurities of P: 0.01% or less, S: 0.01% or less, N: 0.01% or less, and O: 0.01% or less. The parent phase of the maraging steel includes a martensitic phase. The parent phase contains a martensitic phase obtained by reverse transformation from a martensitic phase to an austenitic phase and then transformation from the austenitic phase, in an area fraction of 25% to 75%.

12 Claims, 1 Drawing Sheet

(51) Int. Cl.

| | |
|---|---|
| ***C22C 38/44*** | (2006.01) |
| ***C22C 38/50*** | (2006.01) |
| ***C21D 6/00*** | (2006.01) |
| ***C22C 38/02*** | (2006.01) |
| ***C22C 38/04*** | (2006.01) |
| ***C22C 38/10*** | (2006.01) |

(52) U.S. Cl.
CPC ..... *C22C 38/06* (2013.01); *C22C 38/105* (2013.01); *C22C 38/44* (2013.01); *C22C 38/50* (2013.01); *C21D 2211/001* (2013.01); *C21D 2211/008* (2013.01)

(58) Field of Classification Search
USPC ..... 428/544
See application file for complete search history.

(56) References Cited

OTHER PUBLICATIONS

Extended European Search Report dated Jun. 18, 2020 in European Patent Application No. 187617477, 9 pages.

* cited by examiner

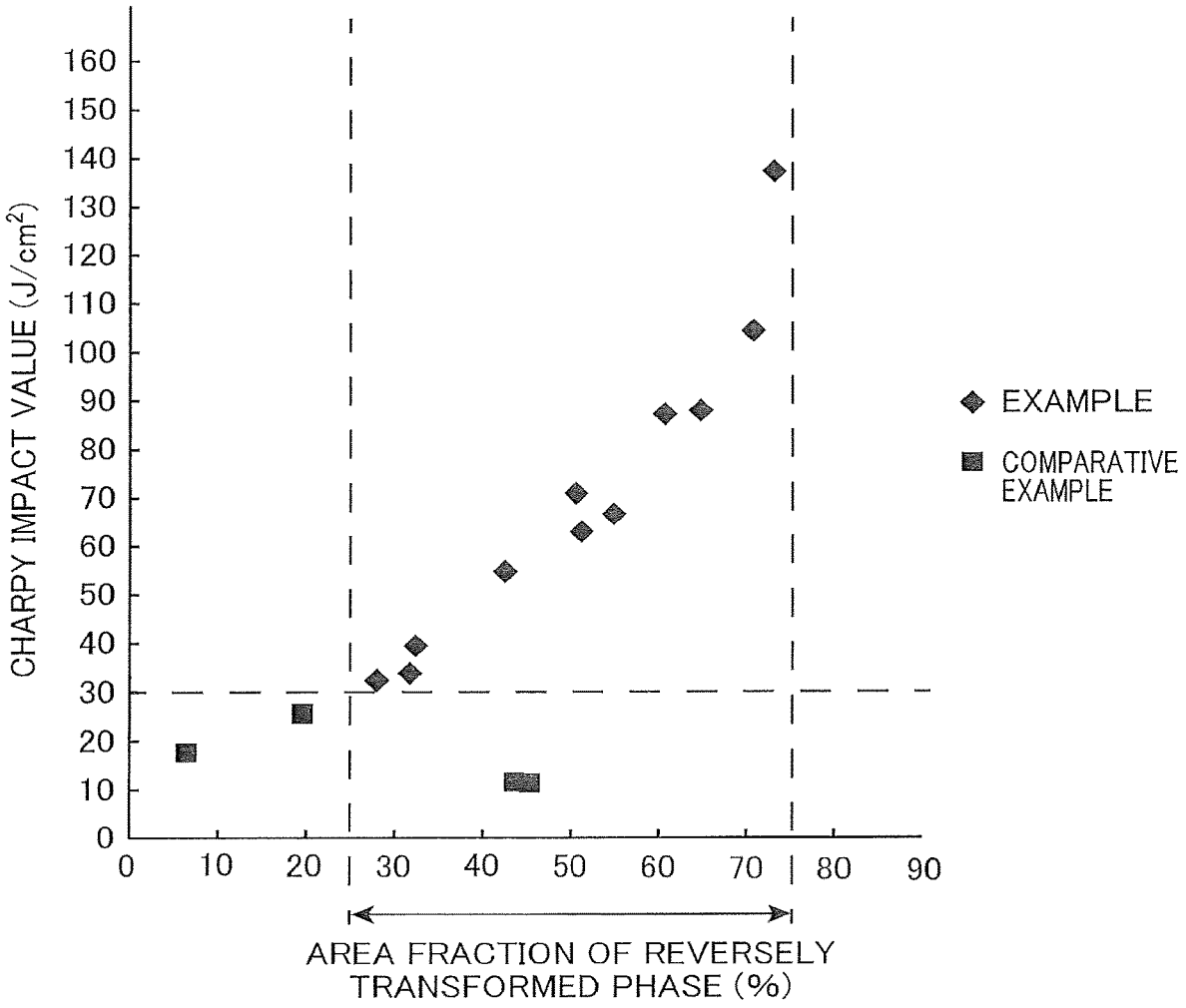
CHARPY IMPACT VALUE (J/cm²)
160
150
140
130
120
110
100
90
80
70
60
50
40
30
20
10
0
0
10
20
30
40
50
60
70
80
90
AREA FRACTION OF REVERSELY TRANSFORMED PHASE (%)
EXAMPLE
COMPARATIVE EXAMPLE

MARAGING STEEL AND METHOD FOR MANUFACTURING SAME

TECHNICAL FIELD

The present invention relates to a maraging steel and a manufacturing method therefor, and more particularly, to a maraging steel which has toughness improved by adjusting the composition ratio of each constituent and the manufacturing conditions, and a manufacturing method therefor.

BACKGROUND ART

Ferritic heat-resistant steels and Ni-based alloys are used for rotors used as core parts of thermal power generation equipment. These materials have, in addition to high-temperature strength, properties such as excellent toughness, low thermal expansion coefficient, and high thermal conductivity. Among the materials, Ni-based alloys which are more excellent in high-temperature strength are adopted for rotors of power generation equipment which is high in operating temperature.

However, since Ni-based alloys are expensive, the application of relatively inexpensive maraging steels has been considered as a substitute for the Ni-based alloys. Maraging steels are low in strength, and easily processed as the steels are subjected to a solution treatment, but the steels are subjected to a quenching treatment and an aging treatment after the solution treatment, thereby making ultrahigh-strength steels with high tensile strength of about 2 GPa at room temperature. In this regard, the quenching treatment refers to a treatment of turning a parent phase into an ultralow-carbon martensitic phase. The aging treatment refers to a treatment of precipitating intermetallic compounds such as $Ni_3Ti$ and $Fe_2Mo$ in a martensitic parent phase.

Patent Literature 1 discloses a technique of adjusting the contents of Ni, Co, Mo, and Ti among the elements constituting a maraging steel. The maraging steel in which the contents of these elements are adjusted has 0.2% proof stress of 700 MPa or more even at a high temperature of 600° C.

The maraging steel disclosed in Patent Literature 1 is high in strength, but poor in toughness. In particular, if the additive amount of Ni is reduced down to 12% by mass in order to increase the transformation temperature of the maraging steel, the toughness will be extremely decreased. For this reason, in order to apply the maraging steel disclosed in Patent Literature 1 to rotors for thermal power generation equipment, there is a need to improve the toughness.

As an attempt to improve the toughness of a maraging steel, for example, Patent Literature 2 discloses a technique of carrying out an overaging treatment at a higher temperature than for a common aging treatment, in addition to the common aging treatment. This overaging treatment is carried out, thereby allowing a part of a martensitic phase, which is a parent material for the maraging steel, to be reversely transformed to an austenitic phase. Containing the austenitic phase reversely transformed in this manner can enhance the toughness of the maraging steel.

As disclosed in Patent Literature 2, however, in a case where the austenitic phase is reversely transformed, the martensitic phase and the austenitic phase coexist. In a case where the maraging steel disclosed in Patent Literature 2 is applied to a rotor of power generation equipment, the maraging steel constituting the rotor at the start and stop of the power generation equipment will have thermal fatigue cause by the difference between in thermal expansion coefficients between the martensitic phase and the austenitic phase. Then, due to this thermal fatigue, the service life of the maraging steel will be decreased. In addition, the austenitic phase is produced as described above, thereby increasing the thermal expansion coefficient of the maraging steel and decreasing the thermal conductivity.

This invention has been achieved in view of the foregoing circumstances, and an object of the invention is to provide maraging steel which is excellent in toughness.

CITATION LIST

Patent Literature

Patent Literature 1: Japanese Patent Application Laid-Open No. 09-111415

Patent Literature 2: Japanese Patent Application Laid-Open No. 51-126918

SUMMARY OF INVENTION

The maraging steel according to one aspect of the present invention contains C: 0.02% by mass or less, Si: 0.3% by mass or less, Mn: 0.3% by mass or less, Ni: 7.0 to 15.0% by mass, Cr: 5.0% by mass or less, Co: 8.0 to 12.0% by mass, Mo: 0.1 to 2.0% by mass, Ti: 1.0 to 3.0% by mass, and Sol.Al: 0.01 to 0.2% by mass, where the balance includes Fe and unavoidable impurities, P, S, N, and O contained as the unavoidable impurities are respectively P: 0.01% by mass or less, S: 0.01% by mass or less, N: 0.01% by mass or less, and O: 0.01% by mass or less, and the parent phase includes a martensitic phase, and the parent phase contains a reversely transformed martensitic phase in an area fraction of 25% to 75%.

The method for manufacturing a maraging steel according to another aspect of the present invention includes: a step of preparing a steel material by melting and casting a raw material containing the above-mentioned respective constituents; a solution treatment step of heating the steel material to 900° C. or higher 1200° C. or lower; a step of cooling the steel material after the solution treatment step; and a step of heating and maintaining the cooled steel material at 675° C. or higher and 740° C. or lower for 1 hour or longer and 10 hours or shorter.

The above-mentioned and other objects, features, and advantages of the present invention will become apparent from the following detailed description and the accompanying drawings.

BRIEF DESCRIPTION OF DRAWINGS

FIG. 1 is a graph showing the correlation between the area fraction (%) of a reversely transformed martensitic phase and the Charpy impact value ($J/cm^2$) in maraging steels according to respective examples and respective comparative examples.

DESCRIPTION OF EMBODIMENTS

The inventors have focused attention on the contents of Mo, Ni, and Co among the constituent elements of a maraging steel, and adjusted the transformation temperature by reducing the content of Mo and adjusting the contents of Ni and Co. Specifically, after a part of a martensitic phase constituting the parent phase is reversely transformed to an austenitic phase by an aging treatment, the transformation temperature is adjusted to be equal to or higher than room temperature such that the austenitic phase is transformed to the martensitic phase at room temperature. Hereinafter, the martensitic phase through the reverse transformation from the martensitic phase to the austenitic phase, and then the transformation to the martensitic phase again is referred to as a "reversely transformed martensitic phase". The inventors have adjusted the transformation temperature, and then adjusted the temperature and time period for the aging treatment, thereby adjusting the precipitation amount of the reversely transformed martensitic phase. As a result, the inventor has demonstrated that when the reversely transformed martensitic phase is contained at an area fraction of 25% or more and 75% or less in the parent phase, the toughness of the maraging steel is improved, and then achieved the present invention.

Embodiments of the present invention will be described in detail below, but the present invention is not to be considered limited thereto.

Characteristically, the maraging steel according to an embodiment of the present invention contains C: 0.02% by mass or less, Si: 0.3% by mass or less, Mn: 0.3% by mass or less, Ni: 7.0 to 15.0% by mass, Cr: 5.0% by mass or less, Co: 8.0 to 12.0% by mass, Mo: 0.1 to 2.0% by mass, Ti: 1.0 to 3.0% by mass, and So1.Al: 0.01 to 0.2% by mass, the balance includes Fe and unavoidable impurities, P, S, N, and O contained as the unavoidable impurities are respectively P: 0.01% by mass or less, S: 0.01% by mass or less, N: 0.01% by mass or less, and O: 0.01% by mass or less, and the parent phase includes a martensitic phase, and the parent phase contains a reversely transformed martensitic phase in an area fraction of 25% to 75%. The respective constituents contained in the maraging steel according to the present embodiment, and the meanings of the numerical range therefor will be described below.

(C: 0.02% by mass or less)

The carbon C is an element which reacts with Ti to precipitate TiC. The precipitation of the TiC makes it difficult to precipitate an intermetallic compound $Ni_3Ti$ that is responsible for high-temperature strength. In other words, reducing the content of C makes TiC less likely to be product, thus making it possible to precipitate $Ni_3Ti$ which is excellent in high temperature strength. For this reason, the content of C is preferably lower, and at most 0.02% by mass or less, preferably 0.01% by mass or less, more preferably 0.005% by mass or less. In addition, C may be contained at 0.0005% by mass or more.

(Si: 0.3% by mass or less)

The silicon Si is an element which decreases the toughness of the maraging steel by forming an oxide. Thus, the content of Si is preferably lower, and at most 0.3% by mass or less, preferably 0.1% by mass or less, more preferably 0.05% by mass or less. In addition, Si may be contained at 0.001% by mass or more.

(Mn: 0.3% by mass or less)

The manganese Mn is, as with the Si mentioned above, an element which decreases the toughness of the maraging steel by forming an oxide. Thus, the content of Mn is preferably lower, and at most 0.3% by mass or less, preferably 0.1% by mass or less, more preferably 0.05% by mass or less. In addition, Mn may be contained at 0.001% by mass or more.

(Ni: 7.0 to 15.0% by mass or less)

The nickel Ni is an essential element for enhancing the toughness of the maraging steel, and is an element that precipitates an intermetallic compound $Ni_3Ti$ through an aging treatment. Precipitating the $Ni_3Ti$ makes it possible to enhance the high-temperature strength of the maraging steel. Thus, the content of Ni is 7.0% by mass or more, preferably 9.0% by mass or more. Ni is also an element that decreases the transformation temperature from the austenitic phase to the martensitic phase (hereinafter, also referred to simply as "transformation temperature"), and it is thus necessary to adjust the content of Ni to 15% by mass or less. The content of Ni is adjusted to 15% by mass or less, thereby making it possible to keep the transformation temperature of the maraging steel from being excessively decreased. Thus, the austenitic phase reversely transformed from the martensitic phase in the aging treatment is transformed to the martensitic phase, without remaining stabilized as the austenitic phase is. As just described, the transformation of the austenitic phase to the martensitic phase in the parent phase, that is, the absence of the austenitic phase remaining in the parent phase, makes it possible to reduce the thermal expansion coefficient of the maraging steel and increase the thermal conductivity. The content of Ni is preferably 13% by mass or less, more preferably 12% by mass or less.

(Cr: 5.0% by mass or less)

The chromium Cr is an element that provides the maraging steel with corrosion resistance. The content of Cr is 5.0% by mass or less, preferably 4.0% by mass or less. The content of Cr is adjusted to 5.0% by mass or less, thereby making the σ phase less likely to be formed even when the maraging steel is used at a high temperature. Thus, the maraging steel can be kept from being embrittled. In addition, Cr may be contained at 0.5% by mass or more.

(Co: 8.0 to 12.0% by mass)

The cobalt Co is an element that promotes the precipitation of intermetallic compounds such as a Laves phase ($Fe_2Mo$) and an R phase ($Fe_{63}Mo_{37}$). Containing 8.0% by mass or more of Co makes the intermetallic compounds more likely to precipitate, thereby making it possible to enhance the strength of the maraging steel. Co is preferably contained 9.0 mass % or more. Co is an element that decreases the transformation temperature, and when Co is contained excessively, a residual austenitic phase is produced. When the residual austenitic phase is contained in the parent phase of the martensitic phase, the thermal expansion coefficient of the maraging steel is increased, and the thermal conductivity of the maraging steel is decreased. Thus, it is necessary to adjust the Co content to 12.0% by mass or less, and the Co content preferably 10.0% by mass or less.

The total content of Ni and Co is preferably 17% by mass or more and 23% by mass or less, more preferably 17.5% by mass or more and 22% by mass or less. Containing Ni and Co to reach such a content can moderately increase the transformation temperature. Thus, after the reverse transformation from the martensitic phase to the austenitic phase, the austenitic phase can be transformed to the martensitic phase. Thus, since the maraging steel can be made free of the austenitic phase, thermal fatigue due to the coexistence of the martensitic phase and the austenitic phase can be avoided, and the life of the maraging steel can be prolonged.

(Mo: 0.1 to 2.0% by mass)

The molybdenum Mo is an element that increases the transformation temperature, and is an element that precipitates intermetallic compounds such as a Laves phase ($Fe_2Mo$) and an R phase ($Fe_{63}Mo_{37}$) through an aging treatment. Containing 0.1% by mass or more of Mo can precipitate the above-mentioned intermetallic compounds, and improve the high-temperature strength of the maraging steel. In addition, Mo is preferably contained at 0.5 mass % or more. Containing Mo to reach such % by mass can increase the transformation temperature. Thus, the austenitic phase produced by reverse transformation is transformed from the austenitic phase to the martensitic phase without being stabilized. In addition, the content of Mo is adjusted to 2.0% by mass or less, thereby making it possible to avoid excessive precipitation of the precipitated products, and avoid a decrease in toughness. The content of Mo is preferably 1.7% by mass or less, more preferably 1.5% by mass or less.

(Ti: 1.0 to 3.0% by mass)

The titanium Ti is an element that increases the transformation temperature, and is an element that precipitates an intermetallic compound $Ni_3Ti$ through an aging treatment. Containing 1.0% by mass or more of Ti can precipitate $Ni_3Ti$. Thus, the high-temperature strength of maraging steel can be improved. Ti is preferably contained at 1.3% by mass or more. Ti is contained to reach such % by mass, thereby making it possible to increase the transformation temperature. Thus, the austenitic phase produced by reverse transformation is transformed from the austenitic phase to the martensitic phase without being stabilized. In addition, the content of Ti is adjusted to 3.0% by mass or less, thereby making it possible to avoid excessive precipitation of the intermetallic compound, and avoid a decrease in toughness. The content of Ti is preferably 2.0% by mass or less.

(Sol. Al: 0.01 to 0.2% by mass)

The Al is an essential constituent for removing oxygen in molten steel. In order to obtain the deoxidation effect, it is necessary for the content of Sol. Al to 0.01% by mass or more, and the content of Sol. Al is preferably 0.05% by mass or more. In this regard, the Sol. Al mentioned above means the Al amount obtained by excluding the Al in $Al_2O_3$ from the Al contained in maraging steel. The maraging steel contains $Al_2O_3$, but the $Al_2O_3$ forms coarse grains in maraging steel, and has little influence on the properties of maraging steel. Thus, it is necessary to exclude the Al in $Al_2O_3$ from the Al contained in the maraging steel, and specify the content of Al that contributes to the properties of the maraging steel. For this reason, the preferred numerical range of Sol.Al is specified. The Sol.Al content of 0.2% by mass or less can avoid precipitation of $Ti_3Al$, and avoid a decrease in the toughness of the maraging steel. The content of Sol. Al is preferably 0.15% by mass or less.

<Unavoidable Impurities>

In the maraging steel according to the present embodiment, the balance other than the above-mentioned elemental constituents is composed of iron (Fe) and unavoidable impurities. The unavoidable impurities include phosphorus P, sulfur S, nitrogen N, and oxygen O. The above-mentioned unavoidable impurities are each 0.01% or less. Thus, the achieved advantageous effect of the present invention can be prevent from being blocked. In addition, the unavoidable impurities other than the elements listed above include, for example, low-melting-point impurity metals such as tin Sn, lead Pb, antimony Sb, arsenic As, and zinc Zn.

(P: 0.01% by mass or less)

The phosphorus P decreases the toughness of the maraging steel, due to microsegregation caused when the molten steel is solidified. Thus, it is necessary to adjust the content of P to 0.01% by mass or less, and preferably 0.005% by mass or less. In addition, P may be contained at 0.001% by mass or more.

(S: 0.01% by mass or less)

The Sulfur S decreases the toughness of the maraging steel. Thus, it is necessary to adjust the content of S to 0.01% by mass or less, and preferably 0.005% by mass or less. In addition, S may be contained at 0.001% by mass or more.

(N: 0.01% by mass or less)

The nitrogen N is an element which forms an inclusion with Ti, thereby decreasing the strength and toughness of the maraging steel. Thus, it is necessary to adjust the content of N to 0.01% by mass or less, and the content of N is preferably 0.005% by mass or less. In addition, N may be contained at 0.001% by mass or more.

(O: 0.01% by mass or less)

The oxygen O forms oxides such as $SiO_2$ and $Al_2O_3$, thereby decreasing the strength of the maraging steel. Thus, it is necessary to adjust the content of O to 0.01% by mass or less, and preferably 0.005% by mass or less. In addition, O may be contained at 0.001% by mass or more.

(Parent Phase)

Next, the crystal structure of the parent phase of the maraging steel according to the present embodiment will be described. In the maraging steel according to the present embodiment, the parent phase is composed of the martensitic phase, without containing the austenitic phase. Thus, thermal fatigue due to the difference in thermal expansion coefficient between the austenitic phase and the martensitic phase is not caused, thus making it possible to avoid a decrease in service life. In addition, since the martensitic phase has a lower thermal expansion coefficient and a higher thermal conductivity as compared with the austenitic phase, the austenitic phase produced by reverse transformation is transformed to the martensitic phase, thereby making it possible to obtain a maraging steel which has a lower thermal expansion coefficient and a higher thermal conductivity.

The reversely transformed martensitic phase is contained in the area fraction of 25% or more and 75% or less in the parent phase, thereby making it possible to enhance the toughness, without decreasing the high-temperature strength of the maraging steel. In this regard, for the area fraction of the reversely transformed martensitic phase, the value is adopted which is obtained from the calculation of the area ratio of the reversely transformed martensitic phase in any region of a cross section of the maraging steel by a scanning electron microscope (SEM: Scanning Electron Microscope) and an analysis of the SEM image. The measurement method therefor will be described in detail in the examples.

The area fraction of the reversely transformed martensitic phase is preferably 30% or more, more preferably 35% or more, further preferably 40% or more. Containing the reversely transformed martensitic phase in such an area fraction can enhance the toughness of the maraging steel. Further, from the viewpoint of avoiding a decrease in the high-temperature strength of the maraging steel, the area fraction of the reversely transformed martensitic phase is preferably 70% or less, more preferably 60% or less, further preferably 55% or less. The area fraction of such a reversely transformed martensitic phase is achieved by adjusting heat treatment conditions for a solution treatment step and an aging step in preparing the maraging steel. These heat treatment conditions will be described later.

<Method for Manufacturing Maraging Steel>

The maraging steel according to the present embodiment can be manufactured typically with a manufacturing facility and a manufacturing process which are industrially used. Specifically, the method for manufacturing the maraging steel according to the present embodiment includes: a step (melting step) of preparing a steel ingot by melting and casting respective raw materials in which the above-mentioned constituents are blended at predetermined contents; a step (homogenization step) of homogenizing segregation generated during the casting by heating the steel ingot to 1100° C. or higher and 1350° C. or lower; a step (forging step) of forging the homogenized steel ingot into a predetermined shape; a step (solution treatment step) of heating the forged steel to 900° C. or higher and 1200° C. or lower; a step (cooling step) of cooling the steel subjected to the solution treatment, to a room temperature or lower; and a step (aging step) of heating and maintaining the cooled steel at 675° C. or higher and 740° C. or lower for 1 hour or longer and 10 hours or shorter. Each of these steps will be described in detail below.

[Melting Step]

The raw materials used in the melting step are selected and blended so as to meet the contents of the respective constituents after undergoing the aging step. In the melting step, the cleanliness of the steel can be increased by melting the raw materials in a vacuum (for example, vacuum induction furnace melting method). Thus, a maraging steel can be obtained which has excellent strength and fatigue resistance. The method may include a step (remelting step) of remelting and casting the ingot obtained in the melting step. Including the remelting step can improve the cleanliness of the steel. The remelting step is preferably repeated more than once in a vacuum (for example, vacuum arc remelting method).

[Homogenization Step]

The treatment conditions for the homogenization step are not to be particularly limited, as long as conditions are capable of removing solidification segregation, and the heating temperature is preferably 1100 to 1350° C., and the heating time is preferably 10 hours or longer. The ingot after the homogenization step is air-cooled, or the ingot remaining red-hot is sent to the forging step.

[Forging Step]

The forging step is typically carried out as hot forging. The treatment conditions for the hot forging are: heating temperature of 900 to 1350° C.; heating time of 1 hour or longer; and end temperature of 800° C. or higher. The forging step may be carried out only once, or may be repeated continuously four to five times. After the forging, annealing may be carried out, if necessary. The annealing is carried out by air cooling, and preferably, the heating temperature is 550 to 950° C., and the heating time is 1 to 36 hours.

[Solution Treatment Step]

The solution treatment step is a step of turning the forged steel into a single γ phase (austenitic phase) and dissolving precipitates such as Mo carbide into the single γ phase. The heating temperature for the solution treatment step is 900 to 1200° C., preferably 950° C. or more. In addition, the heating time is 1 to 10 hours.

[Cooling Step]

The cooling step is a step of transforming the austenitic phase to a martensitic phase by cooling the steel subjected to the solution treatment to a temperature that is equal to or lower than room temperature. The cooling step is carried out, thereby making it possible to enhance the strength improvement effect created by the aging step, more than carrying out the aging treatment with a large amount of austenitic phase remaining. The cooling rate in the cooling step is preferably 0.5° C./s or more, and the cooling time is preferably 1 to 10 hours.

[Aging Step]

The aging step is a step of heating the steel after the cooling step to 675° C. or higher and 740° C. or lower. Heating at 675° C. or higher can reversely transform 25% or more of the martensitic phase in the parent phase in terms of area ratio, to the austenitic phase. This austenitic phase is transformed to a martensitic phase by cooling after the aging step. The aging treatment is preferably carried out at 685° C. or higher, more preferably 700° C. or higher, and the treatment time for the aging step is preferably 1 hour or longer and 10 hours or shorter, more preferably 3 hours or longer and 8 hours or shorter. In addition, the aging step is also a step of precipitating an intermetallic compound, and heating to 740° C. or lower can avoid re-dissolving of the above-mentioned intermetallic compound, and also avoid an excessive increase in the area ratio of the reversely transformed martensitic phase. In addition, the heating temperature for the steel after the cooling step in the aging treatment is preferably 730° C. or lower, more preferably 725° C. or lower, further preferably 715° C. or lower, and particularly preferably 710° C. or lower. The aging treatment is carried out at such a temperature, thereby making it possible to prevent the high-temperature strength from being decreased due to re-dissolving of the intermetallic compound, and keep the area ratio of the reversely transformed martensitic phase from being excessively increased. Since the treatment conditions for such an aging step varies depending on the constituents contained in the maraging steel, it is difficult to specify the conditions uniformly, but for example, it is preferable to carry out the aging step at 700° C. for 3 hours. It is to be noted that the cooling rate after the aging step is not specifically limited, and for example, the steel can also be cooled by air cooling.

This specification discloses various aspects of the technology as described above, and main aspects of the technology will be summarized below.

The maraging steel according to one aspect of the present invention contains C: 0.02% by mass or less, Si: 0.3% by mass or less, Mn: 0.3% by mass or less, Ni: 7.0 to 15.0% by mass, Cr: 5.0% by mass or less, Co: 8.0 to 12.0% by mass, Mo: 0.1 to 2.0% by mass, Ti: 1.0 to 3.0% by mass, and Sol.Al: 0.01 to 0.2% by mass, where the balance includes Fe and unavoidable impurities, P, S, N, and O contained as the unavoidable impurities are respectively P: 0.01% by mass or less, S: 0.01% by mass or less, N: 0.01% by mass or less, and O: 0.01% by mass or less, and the parent phase includes a martensitic phase, and the parent phase contains a reversely transformed martensitic phase in an area fraction of 25% to 75%.

This composition can provide a maraging steel which has excellent toughness.

In the above-mentioned composition, the total content of Ni and Co is preferably 17% by mass or more and 23% by mass or less. Mo is preferably contained at 0.5% by mass or more and 1.7% by mass or less. Ni is preferably contained at 7% by mass or more and 12% by mass or less.

Thus, since the maraging steel can be made free of the austenitic phase, thermal fatigue due to the coexistence of the martensitic phase and the austenitic phase can be avoided, and the life of the maraging steel can be prolonged.

The method for manufacturing a maraging steel according to another aspect of the present invention includes: a step of preparing a steel material by melting and casting a raw material containing the above-mentioned respective constituents; a solution treatment step of heating the steel material to 900° C. or higher 1200° C. or lower; a step of cooling the steel material after the solution treatment step; and a step of heating and maintaining the cooled steel material at 675° C. or higher and 740° C. or lower for 1 hour or longer and 10 hours or shorter.

EXAMPLES

The invention will be described in more detail in the following examples. Steel ingots were prepared by melting and casting 20 kg of raw materials composed of the respective constituents shown in the columns of steel plates A to E in Table 1 below in a vacuum induction melting furnace (VIF: Vacuum Induction Furnace) (melting step). In Table 1, "Tr." means a trace amount (Trace) equal to or less than the analytical limit value, and "Bal." means the balance other than the listed elements: Fe and unavoidable impurities.

The steel ingots thus prepared by melting were subjected to a homogenization treatment at 1280° C. for 12 hours under an argon atmosphere, thereby homogenizing segregation of the constituents during solidification (homogenization step). Next, the steel ingots after the homogenization step were subjected to forging to prepare five types of steel plates A to E of 60 mm wide×15 mm thick (forging step). Each of the steel plates was subjected to a solution treatment at 1000° C. (solution treatment step), and then water-cooled down to room temperature at a cooling rate of 35° C./s (cooling step). Thereafter, the steel plates were subjected to an aging treatment with the temperature and time shown in the column of "aging treatment" in Table 2 (aging step), thereby preparing maraging steels according to the respective examples and respective comparative examples with toughness shown in "Charpy Impact Value" of Table 2. It is to be noted that it was confirmed that the chemical composition met the contents of the respective constituents in Table 1, also in each maraging steel after the aging step.

In the column of "aging treatment" shown in Table 2, the number values above arrows in Examples 9 to 11 mean the time periods required for the changes from the temperatures on the left sides of the arrows to the temperatures on the right sides thereof. For example, the aging treatment in Example 9 means that the aging treatment was carried out by increasing the temperature from 400° C. to 675° C. for 2.75 hours, and keeping the temperature at 675° C. for 3 hours. In addition, according to Examples 6 to 11, water cooling was carried out down to room temperature at a cooling rate of 35° C./s also after the aging treatment.

TABLE 1

| STEEL | CONSTITUENT (% BY MASS) | | | | | | | | | | | | | |
|---|---|---|---|---|---|---|---|---|---|---|---|---|---|---|
| TYPE | Fe | C | Si | Mn | P | S | Ni | Cr | Mo | Co | Ti | Nb | Sol.A1 | N |
| STEEL PLATE A | Bal. | 0.0064 | <0.01 | <0.01 | <0.005 | <0.0005 | 11.95 | 3.06 | 0.96 | 9.83 | 1.98 | Tr. | 0.090 | 0.0005 |
| STEEL PLATE B | Bal. | 0.0077 | <0.01 | <0.01 | <0.005 | <0.0005 | 7.97 | 3.04 | 0.96 | 9.83 | 1.97 | Tr. | 0.093 | 0.0005 |
| STEEL PLATE C | Bal. | 0.0088 | <0.01 | <0.01 | <0.005 | <0.0005 | 11.99 | 3.06 | 1.92 | 9.81 | 1.96 | Tr. | 0.091 | 0.0005 |
| STEEL PLATE D | Bal. | 0.0030 | <0.01 | <0.01 | <0.005 | 0.0014 | 12.13 | 2.99 | 4.97 | 10.29 | 1.98 | <0.01 | 0.090 | 0.0007 |
| STEEL PLATE E | Bal. | 0.0040 | <0.01 | <0.01 | <0.005 | 0.0007 | 12.05 | 2.94 | 4.90 | 20.11 | 1.78 | <0.01 | 0.090 | 0.0005 |

TABLE 2

| | | AGING TREATMENT | REVERSELY TRANSFORMED PHASE TYPE | AREA FRACTION OF REVERSELY TRANSFORMED PHASE (%) | CHARPY IMPACT VALUE (J/cm$^2$) |
|---|---|---|---|---|---|
| EXAMPLE 1 | STEEL PLATE A | 700° C.-3 hr | MARTENSITE | 424 | 54.5 |
| EXAMPLE 2 | STEEL PLATE A | 680° C.-3 hr | MARTENSITE | 32.4 | 39.8 |
| EXAMPLE 3 | STEEL PLATE A | 725° C.-1 hr | MARTENSITE | 73.2 | 137.0 |
| EXAMPLE 4 | STEEL PLATE B | 700° C.-3 hr | MARTENSITE | 27.8 | 32.3 |
| EXAMPLE 5 | STEEL PLATE C | 700° C.-3 hr | MARTENSITE | 51.1 | 62.9 |
| EXAMPLE 6 | STEEL PLATE C | 715° C.-0.3 hr | MARTENSITE | 60.8 | 87.0 |
| EXAMPLE 7 | STEEL PLATE C | 725° C.-0.1 hr | MARTENSITE | 64.8 | 87.8 |
| EXAMPLE 8 | STEEL PLATE C | 725° C.-0.3 hr | MARTENSITE | 70.8 | 104.2 |
| EXAMPLE 9 | STEEL PLATE C | 400° C. $\xrightarrow{2.75\ hr}$ 675° C.-3 hr | MARTENSITE | 31.7 | 33.7 |
| EXAMPLE 10 | STEEL PLATE C | 400° C. $\xrightarrow{3\ hr}$ 700° C.-1 hr | MARTENSITE | 50.6 | 70.7 |
| EXAMPLE 11 | STEEL PLATE C | 400° C. $\xrightarrow{3\ hr}$ 700° C.-3 hr | MARTENSITE | 54.9 | 66.4 |
| COMPARATIVE EXAMPLE 1 | STEEL PLATE A | 650° C.-3 hr | MARTENSITE | 6.4 | 17.6 |

TABLE 2-continued

| | | AGING TREATMENT | REVERSELY TRANSFORMED PHASE TYPE | AREA FRACTION OF REVERSELY TRANSFORMED PHASE (%) | CHARPY IMPACT VALUE ($J/cm^2$) |
|---|---|---|---|---|---|
| COMPARATIVE EXAMPLE 2 | STEEL PLATE A | 650° C.-30 hr | MARTENSITE | 19.7 | 25.7 |
| COMPARATIVE EXAMPLE 3 | STEEL PLATE D | 700° C.-3 hr | MARTENSITE | 43.5 | 11.7 |
| COMPARATIVE EXAMPLE 4 | STEEL PLATE E | 700° C.-3 hr | AUSTENITE | 45.1 | 11.3 |

Each of the maraging steels according to the respective examples and the respective comparative examples was electropolished with a common electropolishing solution, and a region at the polished surface was photographed with an SEM. Then, the reversely transformed martensitic phase in the area of 1026 $\mu m^2$ in the cross section observed under the SEM was subjected to mapping with the use of the shot photograph. Then, the percentage of the area ratio of the reversely transformed martensitic phase in the photograph was calculated by identifying the reversely transformed martensitic phase with the use of image processing software while checking the photograph shot as mentioned above. The results are shown in the column of "Area fraction of Reversely Transformed Phase" of Table 2. Further, the reversely transformed phase (reversely transformed martensitic phase or reversely transformed austenitic phase) observed here is shown in the column of "Reversely Transformed Phase Type".

The steel plates according to the respective examples and the respective comparative examples were processed into V-notched standard test pieces as defined in the JIS Z 2242. For each of the test pieces obtained by this processing, the Charpy impact value at 0° C. was measured in accordance with the Charpy impact test method for metal materials as defined in the JIS Z 2242. The results are shown in the column of "Charpy Impact Value" of Table 2. The results indicate that as the Charpy impact value is increased, the toughness is better. It is determined that the toughness is favorable in a case in which the Charpy impact value is 30 $J/cm^2$ or more. This criterion is set in consideration of the use conditions (thermal stress) of a rotor for thermal power generation equipment.

FIG. 1 is a graph showing the correlation between the area fraction (%) of the reversely transformed martensitic phase and the Charpy impact value ($J/cm^2$) in the maraging steels according to the respective examples and the respective comparative examples, where the vertical axis indicates the Charpy impact value is ($J/cm^2$), whereas the horizontal axis indicates the area fraction (%) of the reversely transformed martensitic phase. It is to be noted that in Comparative Example 4, the area fraction of the reversely transformed austenitic phase is regarded as the area fraction of the reversely transformed martensitic phase, and plotted in the graph of FIG. 1.

(Consideration)

In the maraging steels according to the respective examples, the contents of the various constituents meet the predetermined numerical ranges as shown in Table 1, and meet the temperature and time period for the aging step as shown in Table 2, and thus, the area fraction of the reversely transformed martensitic phase meets 25% or more and 75% or less. For this reason, the maraging steel according to each example has a Charpy impact value in excess of 30 $J/cm^2$, and thus has excellent toughness. Furthermore, none of the maraging steels according to the respective examples contain the austenitic phase, because the reversely transformed austenitic phase is transformed from the austenitic phase to the martensitic phase. For this reason, the maraging steels according to the respective examples can be considered composed of a crystal structure which has a low thermal expansion coefficient and a high thermal conductivity.

On the other hand, the maraging steels according to Comparative Examples 1 and 2 failed to achieve the effect of improving the toughness of the maraging steel, because the heat treatment temperature in the aging step was as low as 650° C., thereby resulting in the insufficient area fraction of the reversely transformed martensitic phase. Moreover, the maraging steels according to Comparative Examples 3 and 4 are considered to have maraging steel toughness decreased by excessive intermetallic compounds precipitated in the parent phase due to excessively containing Mo. In particular, in Comparative Example 4, since Co is excessively contained in addition to excessively containing Mo, the reversely transformed austenitic phase is considered remaining as the austenitic phase without being transformed to a martensitic phase. As in the maraging steel according to Comparative Example 4, the reversely transformed austenitic phase remaining without being transformed to a martensitic phase is considered to increase the thermal expansion coefficient and decrease the thermal conductivity.

It is to be noted that in a case where the heat treatment temperature in the aging step exceeds 740° C., the area fraction of the reversely transformed martensitic phase exceeds 75%, thereby increasing the Charpy impact value of the maraging steel. It has been confirmed that in a case where the aging step is carried out at the heat treatment temperature in excess of 740° C., re-dissolving of the precipitated products is caused, thereby failing to meet the other properties (for example, high temperature strength) required for the maraging steel. For this reason, in order to meet the properties (for example, high-temperature strength) required for the maraging steel, there is a need to adjust the heat treatment temperature in the aging step needs to 740° C. or lower, and there is a need to adjust the area fraction of the reversely transformed martensitic phase to 75% by mass or less.

The comparison between the respective examples and the respective comparative examples has demonstrated that maraging steels with excellent toughness can be obtained by achieving the predetermined contents of the respective constituents and meeting the predetermined heat treatment conditions in the aging step, thereby showing the advantageous effect of the present invention.

This application is based on Japanese Patent Application No. 2017-039149 filed on Mar. 2, 2017 and Japanese Patent Application No. 2017-093877 filed on May 10, 2017, the contents of which are incorporated in the present application.

Although the present invention has been described appropriately and sufficiently through the embodiments with reference to the previously described specific examples and the like in order to describe the present invention, it should be understood that one skilled in the art could easily modify and/or improve the previously described embodiments. Accordingly, unless a change or improvement made by one skilled in the art remains at a level that departs from the scope of the claims, the change or the improvement is interpreted as being included in the scope of the claims.

INDUSTRIAL APPLICABILITY

The present invention has broad industrial applicability in technical fields related to maraging steels and manufacturing methods therefor.

The invention claimed is:

1. A maraging steel, containing:

Fe:

C: 0.02% by mass or less;

Si: 0.3% by mass or less;

Mn: 0.3% by mass or less;

Ni: 7.0 to 15.0% by mass;

Cr: 5.0% by mass or less;

Co: 8.0 to 12.0% by mass;

Mo: 0.1 to 2.0% by mass;

Ti: 1.0 to 3.0% by mass;

Sol.Al: 0.01 to 0.2% by mass; and unavoidable impurities including:

P: 0.01% by mass or less;

S: 0.01% by mass or less;

N: 0.01% by mass or less; and

O: 0.01% by mass or less, wherein a parent phase of the maraging steel includes a martensitic phase, and the parent phase contains a martensitic phase obtained by reverse transformation from a martensitic phase to an austenitic phase and then transformation from the austenitic phase, in an area fraction of 25% to 75%.

2. The maraging steel according to claim 1, wherein a total content of Ni and Co is 17% by mass or more and 23% by mass or less.

3. The maraging steel according to claim 1, wherein Mo is contained at a content of 0.5% by mass or more and 1.7% by mass or less.

4. The maraging steel according to claim 1, wherein Ni is contained at a content of 7% by mass or more and 12% by mass or less.

5. The maraging steel according to claim 1, wherein Mo is in an amount of 0.5 to 1.7% by mass.

6. The maraging steel according to claim 1, wherein Mo is in an amount of 0.5 to 1.5% by mass.

7. The maraging steel according to claim 1, wherein Ni is in an amount of 9.0 to 13.0% by mass.

8. The maraging steel according to claim 1, wherein Ni is in an amount of 9.0 to 12.0% by mass.

9. The maraging steel according to claim 1, wherein Co is in an amount of 9.0 to 12.0% by mass.

10. The maraging steel according to claim 1, wherein Co is in an amount of 8.0 to 10.0% by mass.

11. The maraging steel according to claim 1, wherein the area fraction is from 35% to 60%.

12. The maraging steel according to claim 1, wherein the area fraction is from 40% to 55%.

* * * * *